US007167169B2

(12) United States Patent
Libsch et al.

(10) Patent No.: US 7,167,169 B2
(45) Date of Patent: Jan. 23, 2007

(54) ACTIVE MATRIX OLED VOLTAGE DRIVE PIXEL CIRCUIT

(75) Inventors: Frank R Libsch, White Plains, NY (US); James L Sanford, Hopewell Junction, NY (US)

(73) Assignee: Toppoly Optoelectronics Corporation (TW)

( * ) Notice: Subject to any disclaimer, the term of this patent is extended or adjusted under 35 U.S.C. 154(b) by 303 days.

(21) Appl. No.: 10/300,417

(22) Filed: Nov. 20, 2002

(65) Prior Publication Data

US 2003/0107565 A1 Jun. 12, 2003

Related U.S. Application Data

(60) Provisional application No. 60/332,389, filed on Nov. 20, 2001.

(51) Int. Cl.
*G09G 5/00* (2006.01)

(52) U.S. Cl. ..... 345/211; 345/82

(58) Field of Classification Search ..... 345/82, 345/84, 204, 205, 211–213; 315/169.3
See application file for complete search history.

(56) References Cited

U.S. PATENT DOCUMENTS

| | | | | |
|---|---|---|---|---|
| 5,302,966 | A * | 4/1994 | Stewart | 345/76 |
| 5,552,678 | A * | 9/1996 | Tang et al. | 315/169.3 |
| 5,952,789 | A | 9/1999 | Stewart et al. | 315/169.4 |
| 6,229,506 | B1 | 5/2001 | Dawson et al. | 345/82 |
| 6,229,508 | B1 | 5/2001 | Kane | 345/82 |
| 6,366,025 | B1 * | 4/2002 | Yamada | 315/169.3 |
| 6,580,657 | B1 * | 6/2003 | Sanford et al. | 365/230.05 |
| 6,583,581 | B1 * | 6/2003 | Kaneko et al. | 315/169.3 |
| 6,611,108 | B1 * | 8/2003 | Kimura | 315/169.3 |
| 6,730,966 | B1 * | 5/2004 | Koyama | 257/350 |
| 6,747,639 | B1 * | 6/2004 | So | 345/211 |
| 6,828,950 | B1 * | 12/2004 | Koyama | 345/76 |
| 6,859,193 | B1 * | 2/2005 | Yumoto | 345/82 |
| 6,888,318 | B1 * | 5/2005 | Childs | 315/169.3 |
| 2002/0047568 | A1 * | 4/2002 | Koyama | 315/169.3 |
| 2002/0047581 | A1 * | 4/2002 | Koyama | 315/169.3 |
| 2002/0053884 | A1 * | 5/2002 | Kimura | 315/169.3 |
| 2002/0101172 | A1 * | 8/2002 | Bu | 315/169.3 |

OTHER PUBLICATIONS

Kimura, M. et al, "TFT-LEPD with Image Uniformity by Area Ratio Gray Scale," Seiko Epson Corp., Japan, AMLDC, 2000.

Miyaguchi S. et al., "Organic LED full-color passive-matrix display," Journal of the DIS 7/3, 1999, pp. 221-226.

Brody, T.P. et al, "A 6×6-in 20-lpi Electroluminescent Display Panel," IEEE Transactions On Electron Devices, vol. 22, No. 9, Sep. 1975, pp. 739-748.

(Continued)

*Primary Examiner*—Amr A. Awad
*Assistant Examiner*—Tom Sheng
(74) *Attorney, Agent, or Firm*—Ohlandt, Greeley, Ruggiero & Perle, L.L.C.

(57) ABSTRACT

There is provided a circuit for driving a current mode light modulating device. The circuit includes (a) a capacitor for storing a data voltage, (b) a field effect transistor (FET) controlled by a signal on a scan line, for coupling the data voltage from a signal line to the capacitor, and (c) a current source, controlled by the stored data voltage, for driving the device with current provided from a power line. The power line is in a plane that is geometrically parallel to a plane within which the scan line is located.

15 Claims, 17 Drawing Sheets

OTHER PUBLICATIONS

Sasaoka, T. et al, "24.4L: Late-New Paper: A 13.0-inch AM-OLED Display with Top Emitting Structure and Adaptive Current Mode Programmed Pixel Circuit (TAC)," Organic EL Development Department, Core Technology & Network Co., Sony Corp., SID 01 Digest, 2001, pp. 384-387.

Tam, S. W-B et al., "Improved Polysilicon TFT Drivers for Light Emitting Polymer Dysplay," Epson Cambridge Lab., Cambridge, UK, 2000, pp. 243-246.

Johnson, M.T. et al., "Active Matrix PolyLED Displays," Philips Research Labs, Eindhove, The Netherdlands, 2000, pp. 235-238.

Tam, S. W-B et al., "Polysilicon TFT Drivers for Light Emitting Polymer Dysplay," Epson Cambridge Lab., Cambridge, UK, 1999, pp. 175-178.

Kimura, M. et al, "Low-Temperature Ply-Si TFT Driven Light-Emitting-Polymer Displays and Digital Gray Scale for Uniformity," Seiko Epson Corp., Japan, AMLDC, 1999.

* cited by examiner

ACTIVE MATRIX OLED VOLTAGE DRIVE PIXEL CIRCUIT

CROSS REFERENCE TO RELATED APPLICATIONS

The present application is claiming priority of U.S. Provisional Patent Application Ser. No. 60/332,389, filed on Nov. 20, 2001.

BACKGROUND OF THE INVENTION

1. Field of the Invention

The present invention relates to a pixel circuit, and more particularly, to an active matrix organic light emitting diode (AMOLED) pixel circuit that can be implemented with amorphous silicon thin film transistors.

2. Description of the Prior Art

Several conventional active matrix drive schemes that have been used in liquid crystal display (LCDs) and are being investigated for use in AMOLEDs. These schemes include, for example, (1) an area ratio gray scale (ARG) method (M. Kimura, et al, Seiko Epson Corp., Japan, AMLDC2000), (2) a pulse width modulation method (S. Miyaguchi, et al, J. of SID, 7(3), 1999, p. 221–226), and (3) an amplitude modulation method, as used in direct view active matrix liquid crystal displays (AMLCDs).

A display-driving scheme for an array of pixels is dependent on pixel schematic, a computer aided design (CAD) layout and a manner in which control lines are brought out of the array. For example, a prior art AMOLED pixel structure having two NMOS transistors provides a current from a driver transistor that drives an OLED being switched, where the drain of the driver transistor is brought out of the array as a column line. In such a layout, the column line that supplies the current (i.e., the supply line) cannot be scanned in sync with rows lines, but must either be OFF until all the row lines are scanned or must be ON before the row lines are scanned. This aspect, as well as the layout of other control signals (e.g., whether they are brought out as row, column or common lines), dictate possible driving options. Active matrix and OLED technology, together with pixel design, dictate which driving scheme produces a least amount, or an acceptable level of, front-of-screen artifacts. For example, there is a common belief among those skilled in the display art that amorphous silicon (a-Si) thin film transistors (TFTs) are not a suitable technology for driving an OLED display, even though a-Si TFT technology is by choice and sales the mainstream technology used in AMLCDs today. Thus, conventional AMOLED displays are implemented with low temperature polysilicon (LTPS) TFT technology, and to date, no one has implemented an a-Si TFT OLED display. Some of the cited concerns are (1) an insufficient low level of drive current produced by an a-Si TFT (M. Stewart et al, IEEE IEDM, 1998, pp. 871–874; LG, SID 2001), which stems from an inherently low mobility (typically<1 $cm^2/V/sec$ and, (2) threshold voltage instabilities (J. Kanicki et al, SID 20th IDRC Proceedings, Sept. 25–28, Palm Beach, Fla., pp. 354–358).

FIG. 1 is a schematic of a conventional TFT-electroluminescent active matrix pixel circuit (T. Brody et al, IEEE TED Vol. 22, No. 9, 1975, pp 739–748). FIG. 2 is a schematic and timing diagram of a conventional matrix array implementation. This same active matrix has also been applied in driving OLEDs, but one problem is that the active matrix is known to suffer from pixel-to-pixel luminance non-uniformity due to variation of a TFT threshold voltage of a driver TFT, e.g., driver Q2, (T. Sasaoka et al, 2001 SID International Symposium Digest (Sony)). Another problem is that gray-scale is related to the drain voltage of the TFT driver Q2, Vd, in a highly non-linear fashion, which makes data driver voltage corrections difficult (S. Tam et al, Proceedings of International Display Workshop 2000, AMD6-3). One of the principal purposes of the active matrix is to provide a frame-period storage in each pixel, where Q1, the pixel's data write TFT, and Cs, the pixel's data storage capacitance, store a pixel voltage as in a conventional a-si TFT LCD display. Unlike a liquid crystal display, where the LC capacitor is a voltage mode light modulator, an electroluminescent phosphor (or OLED) is a current mode light modulator and cannot be used as a voltage mode storage capacitor, thereby incorporating Cs. Cs is incorporated because a current mode light modulator cannot be used as a voltage mode storage capacitor. In addition, because of the current mode light modulator OLED element, driver Q2 provides the necessary driving current.

Several references show implementations and provide discussions of an active matrix having two TFTs per pixel (T. Sasaoka et al, 2001 SID International Symposium Digest (Sony); M. Johnson et al, 2000 International Display Workshop, pp 235–238; S. Tam et al, 1999 International Display Workshop, AMD3-2, M. Kimura et al, Proceedings of International Display Workshop 1999, AMD3-1). In these references, the technology is poly-Si TFT, and the drain of all Q2 TFTs in each pixel are tied together, brought out of the active matrix as a column line, and tied to a DC voltage supply as shown in FIG. 2. The specific Q2 shown in FIG. 2 is shown in each reference listed above, i.e., each of these references include a TFT where all of the Q2 TFTs perform the same role. Because of these limitations and drawbacks, other pixels circuits have evolved, but they rely on three, four or more TFTs per pixel. See for example, (a) U.S. Pat. No. 5,952,789 to Roger Green Stewart and Alfred Ipri, Sep. 14, 1999, (b) U.S. Pat. No. 56,229,506 to Robin Dawson et al, May 8, 2001, and (c) U.S. Pat. No. 6,229,508 to M. Kane, May 8, 2001. However, since it is desirable to maximize fabrication yield, minimizing the number of TFTs per pixel that need to be addressed and minimizing the capacitors per pixel and the number of conductor layer crossovers, which is often proportional to the number of pixel control lines, is given serious priority. In addition the complexity of the driving scheme, and the associated costs for such items as higher performance, larger function drivers and display controllers, will increase for large number of TFTs per pixel that need to be addressed.

SUMMARY OF THE INVENTION

The present invention provides for a pixel circuit having a minimal number of TFTs and capacitors, and a minimal number of control lines, while providing (1) a data voltage write to the pixel, and (2) a threshold voltage independent voltage-to-current conversion followed by pixel illumination.

Another feature of the present invention is to provide a driving technique for an active matrix OLED display using circuit having two TFTs per pixel.

Another feature of the present invention is to provide a pixel circuit compatible with a voltage amplitude modulated data driver and a pulse width modulated driver.

Another feature of the present invention is to provide a driving scheme that (1) minimizes an initial TFT threshold voltage shift, especially in a current drive TFT, (2) minimizes stress effects of the TFTs that results in a time dependent threshold voltage shift, especially in the current drive TFT, (3) provides reverse polarity and alternating current (AC) voltages on TFT terminals to prolong TFT lifetime, and (4) provides quick data voltage level charging of the pixel.

An additional aspect of the present invention is to provide an OLED architecture that facilitates reverse bias of a scanned OLED array. Since an OLED is a thin film device, charge can build up when driven normally in a forward bias manner. Reversing the voltage across the OLED can remove built-up charge and help to maintain low voltage operation.

Additionally, the present invention (1) maximizes pixel aperture area, (2) provides a pixel circuit and layout that can be employed for either a bottom emission AMOLED display or a top emission AMOLED display. Furthermore, the present invention maximizes manufacturing yield by providing a simple process and high yielding pixel circuitry and layout with low-cost fabrication processing.

One embodiment of the present invention is a circuit for driving a current mode light modulating device. The circuit includes (a) a capacitor for storing a data voltage, (b) a field effect transistor (FET) controlled by a signal on a scan line, for coupling the data voltage from a signal line to the capacitor, and (c) a current source, controlled by the stored data voltage, for driving the device with current provided from a power line. The power line is in a plane that is geometrically parallel to a plane within which the scan line is located.

Another embodiment of the present invention is an AMOLED display having a plurality of pixel circuits in a row. Each of the pixel circuits includes (a) a capacitor for storing a data voltage, (b) a first field effect transistor (FET) controlled by a signal on a scan line, for coupling the data voltage from a signal line to the capacitor, and (c) a second FET, controlled by the stored data voltage, for driving an AMOLED in the display with current provided from a power line. The power line is in a plane that is geometrically parallel to a plane within which the scan line is located, and the power line and the scan line are connected to each of the pixel circuits in the row.

DESCRIPTION OF THE INVENTION

The present invention relates to an AMOLED pixel circuit having four modes of operation, namely (1) fast data sample and hold mode, (2) sufficient drive (illumination) current mode, (3) TFT threshold voltage compensation mode, and (4) OLED compensation mode. The circuit is configured with a minimal number of components thus allowing for a favorable aperture ratio.

The pixel circuit uses a-Si technology and incorporates several features: (1) the drains of driver transistor Q2 in a row, or group of rows, are tied together; (2) the power lines are brought out of the active matrix as a row line versus the Vsupply lines that are brought out as column lines, and (3) Vdata is a pulsed signal. The present invention offers a simple implementation of a pixel circuit with only a few TFTs, and may provide a defacto pixel adaptation by a-Si TFT-OLED display makers.

Figure 1:
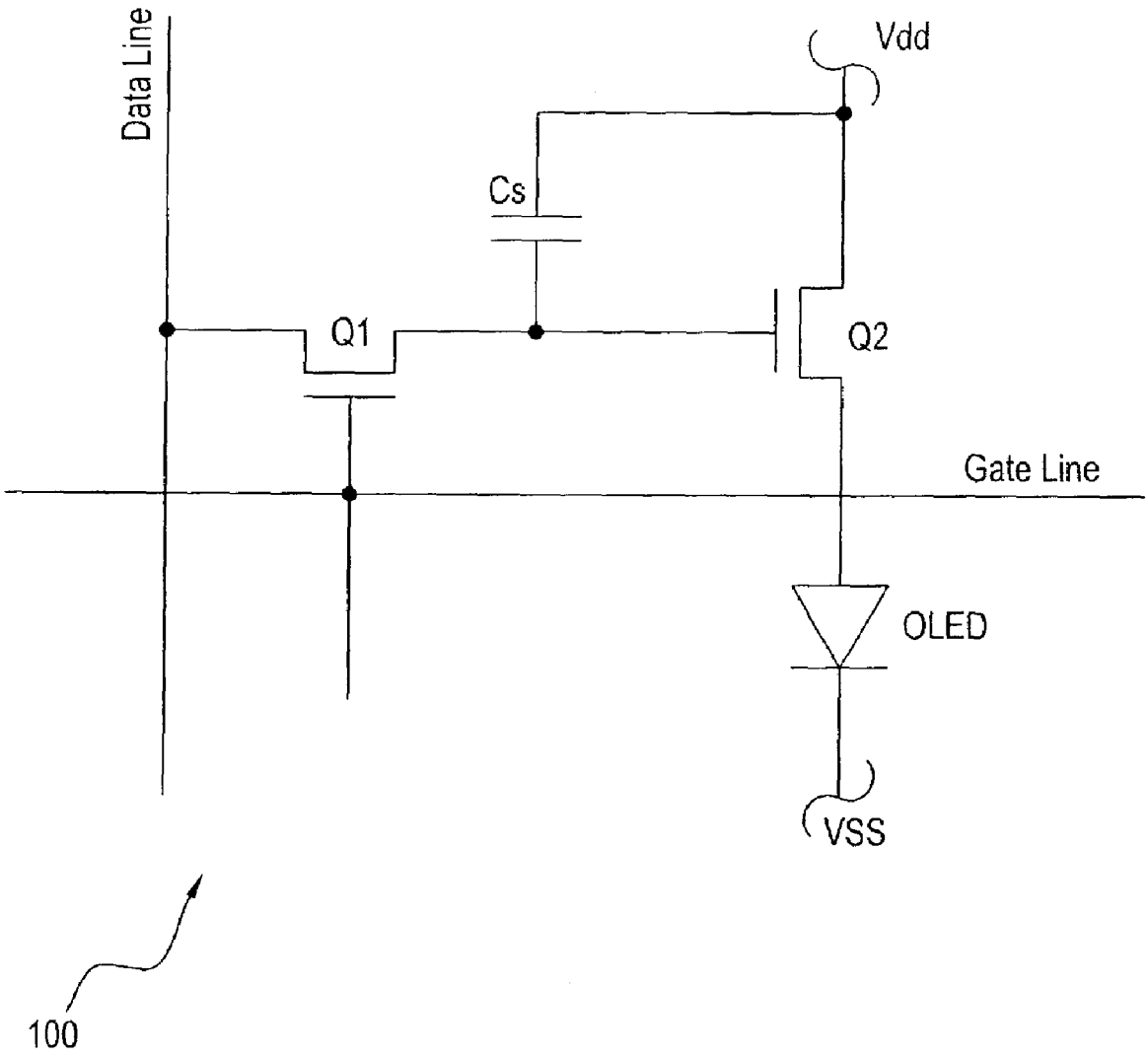
Fig. 1 (Prior Art)
FIG. 1 is a schematic of a conventional TFT-electroluminescent active matrix pixel circuit.
Figure 2:
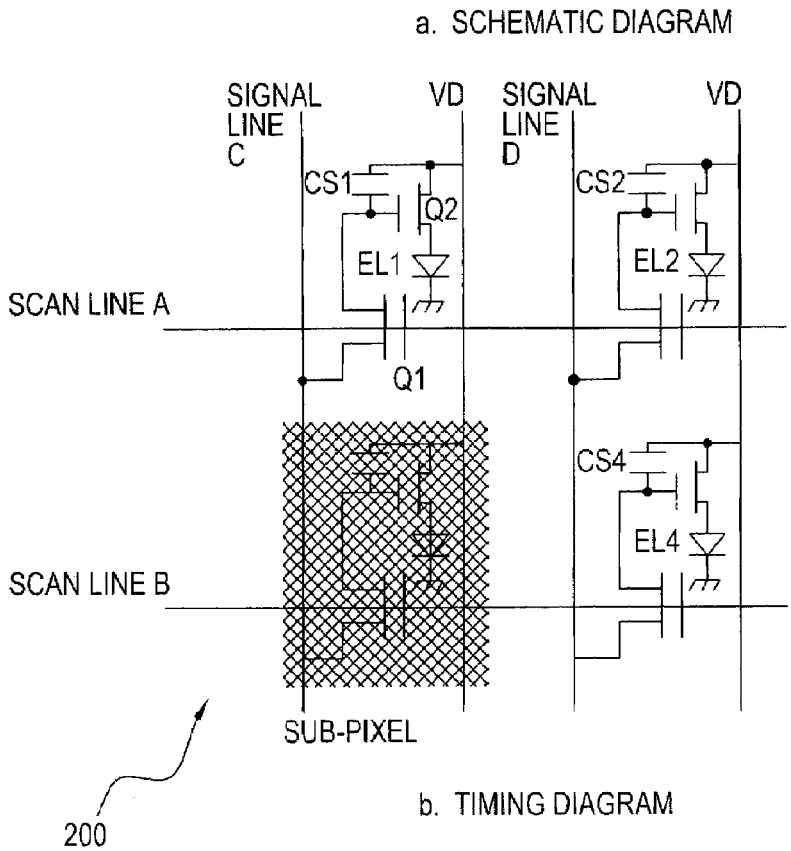
Fig. 2 (Prior Art)
FIG. 2 is a schematic and timing diagram of a conventional matrix array implementation.
Figure 2:
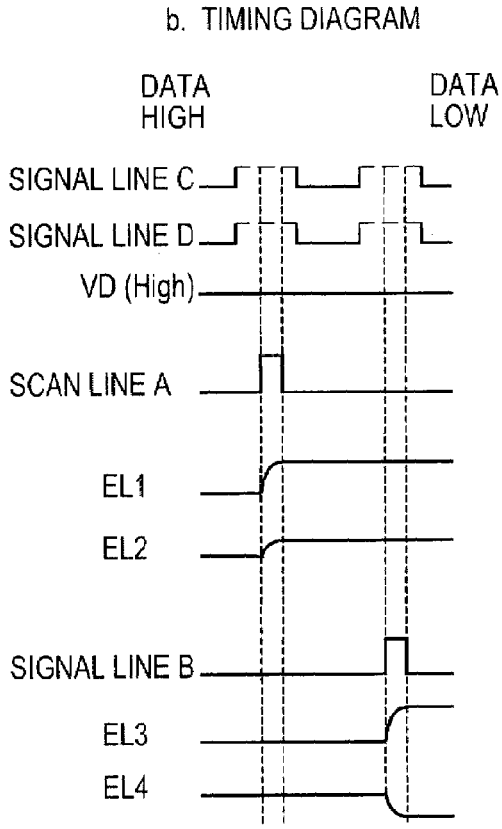
Fig. 2 (Prior Art)
Figure 3:
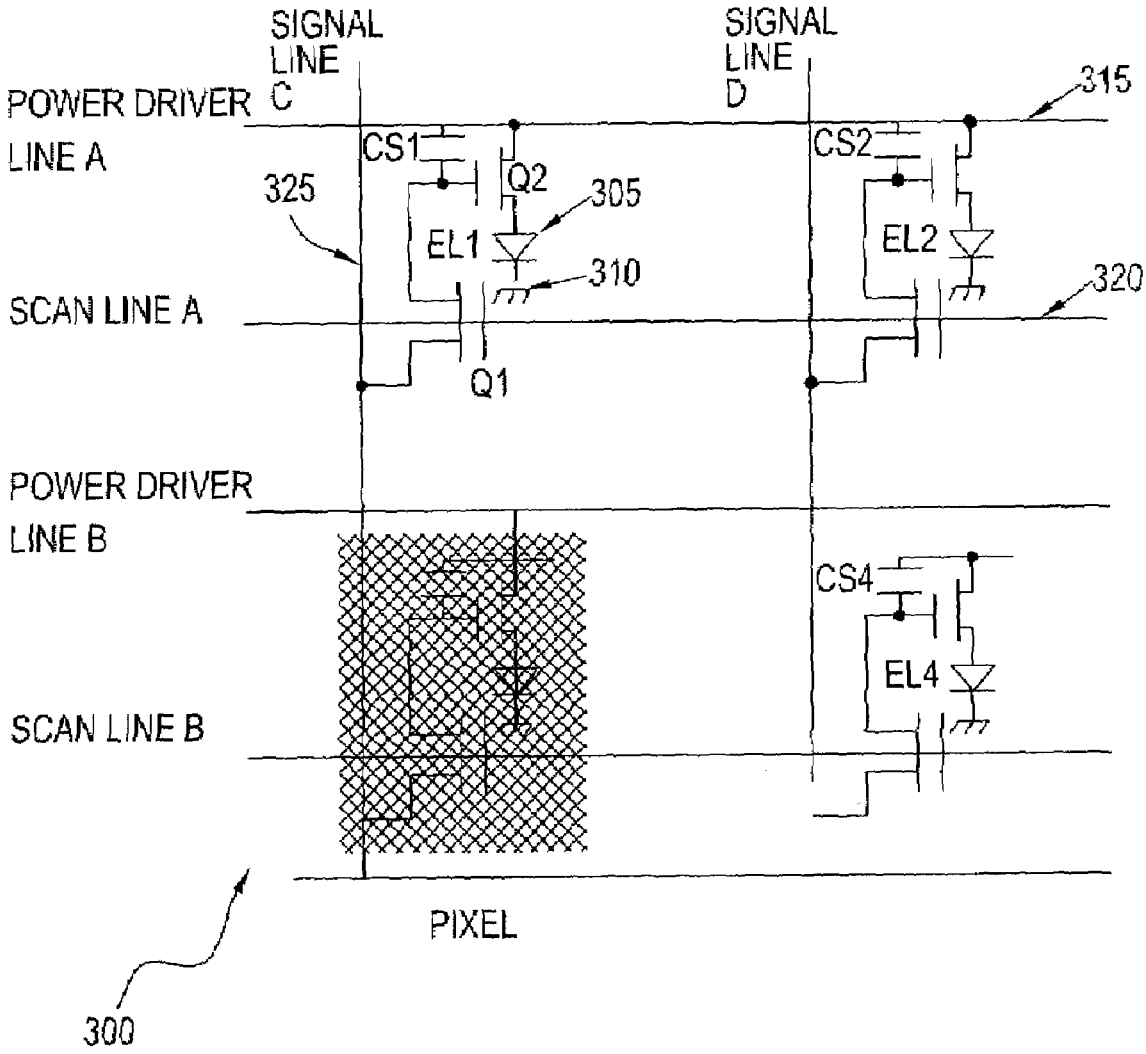
FIG. 3 is a schematic of a circuit for an active matrix in accordance with the present invention.

FIG. 3 is a schematic of a circuit 300 for an active matrix in accordance with the present invention. Circuit 300 includes a plurality of pixel circuits, four of which are shown, namely pixel circuits EL1, EL2, EL3 and EL4. Taking EL1 as a representative pixel, it includes a storage capacitor Cs1, a data transfer transistor Q1, a driver transistor Q2, a scan line 320, a power driver line 315, a signal line 325, and a common cathode 310.

Data transfer transistor Q1 and driver transistor Q2 are connected to a common node. Storage capacitor Cs1 is connected between the common node and power driver line 315.

Pixel circuit EL1 drives a current mode light modulating device, e.g., an OLED 305. Other examples of current mode light modulating devices include inorganic light emitting diodes using electroluminescent phosphor and field emission devices.

Scan line 320 is a conductor for a voltage Vscan, which is typically supplied by a row driver (not shown). Vscan is also referred to herein as V(132), and further identified by a row number (e.g., 1, 2, 3 . . . N). In an embodiment of a full display, scan line 320 is connected to a plurality of pixel circuits in a row of the display. A scan line is provided for each row of the display. That is, a first scan line for the first row, a second scan line for the second row, etc.

Power driver line 315 is a conductor for a voltage Vsupply, which is also typically supplied by a row driver (not shown). In an embodiment of a full display, power driver line 315 is connected to a plurality of pixel circuits in a row of the display. A power driver line is provided for each row of the display. That is, a first power driver line for the first row, a second power driver line for the second row, etc.

Note that Vsupply is an AC waveform, In a physical embodiment of circuit 300, power driver line 315 is preferably in a plane that is geometrically parallel to, and electrically isolated from, a plane within which scan line 320 is located. Several favorable consequences result from this configuration. For example:

(1) OLED 305 can be illuminated using a duty cycle of less than 100%;

(2) storage capacitor Cs1 can take advantage of a bootstrapping technique to accelerate charging of Cs1;

(3) waveforms on power driver line 315 and scan line 320 can be coordinated to provide threshold compensation for driver Q2; and (4) waveforms on power driver line 315 and Vcathode 310 can be coordinated to provide reversal of trapped charges for OLED 305.

The row driver for Vscan and the row driver for Vsupply may reside on a single row driver chip or may reside on separate row driver chips. Power driver line 315 is contemplated as providing a higher current than scan line 320.

Signal line 325 is a conductor for a voltage Vdata that represents a gray level voltage amplitude. Vdata is supplied by a data driver (not shown).

Common cathode 310 is a conductor for a voltage Vcathode, which is an AC waveform. Each of pixel circuits EL1–EL4 drive an OLED, and Vcathode is common to one side of the OLED for each of EL1–EL4. In a full AMOLED array, Vcathode may be common to all of the AMOLEDs in the array, or to a subset of AMOLEDs in the array. For example, such a subset can encompass one row of pixel circuits or several rows of pixel circuits. An advantage of such a subset by row grouping is that simultaneous addressing of an upper portion and a lower portion of the AMOLED array provides a quicker addressing of the full array than can be accomplished by addressing single rows in sequence.

Although circuit 300 is shown with a common cathode configuration, i.e., the cathode of OLED 305 is tied to common cathode 310, it could have a common anode configuration. That is, rather than having the cathodes of the OLEDs connected together as shown in FIG. 3, the driver (e.g., Q2) in a pixel circuit could be connected to the cathode and the anodes of a plurality of OLEDs could be connected together.

Q1 operates as a pixel data write transfer switch from a gray level voltage Vdata on signal line 325 to a gate node of driver Q2 when voltage Vscan on scan line 320 is sufficiently positive. Driver transistor Q2 operates as a voltage follower to drive OLED 305. Current through OLED 305 is sourced from voltage supply Vsupply, connected to power driver line 315. As OLED 305 is driven, a threshold voltage of driver transistor Q2 changes. Voltage across OLED 305 is equal to Vsupply-Vcathode-Vgs(t), where Vcathode is a voltage on common cathode 310, and Vgs(t) is a time dependent gate-to-source voltage of Q2. Current through OLED 305 and driver transistor Q2 is proportional to $(Vgs-Vt)^2$, where Vt is the threshold voltage of Q2. In addition, driver Q2 is biased in saturation (Vds>Vgs−Vti), where Vds is the TFT drain-to-source voltage, and Vti is the TFT initial threshold voltage before biasing induces additional TFT threshold voltage shifts. Such biasing results in a much reduced threshold voltage shift (2× to 20×) as compared to the same gate biasing of Q2 but with a smaller Vds such as in the linear region (Vds<Vgs−Vti).

Figure 8A:
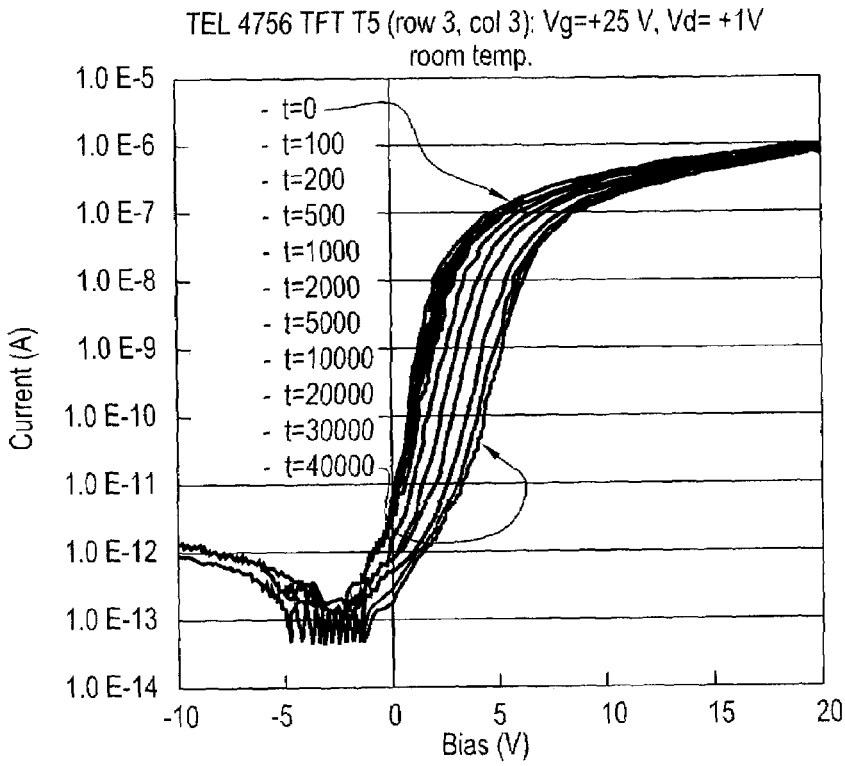
FIG. 8*a* is a graph of drain current versus gate bias.

FIG. 8*a* is a graph of drain current versus gate bias for TFT with channel width-to-length ratio (W/L) of 50/7, driven in linear regime (Vg=25 V, Vd=1 V). FIG. 8*a* shows driver Q2 drain to source current versus gate bias as a function of stress time for the bias-temperature-stress (BTS) condition of driver Q2 biased in the linear region with Vgs=25V, Vds=1V at room temperature. The curves from left to right result from the BTS times of 0, 100, 200, 500, 1000, 2000, 5000, 10,000, 20,000, 30,000 and 40,000 seconds, respectively.

Figure 8B:
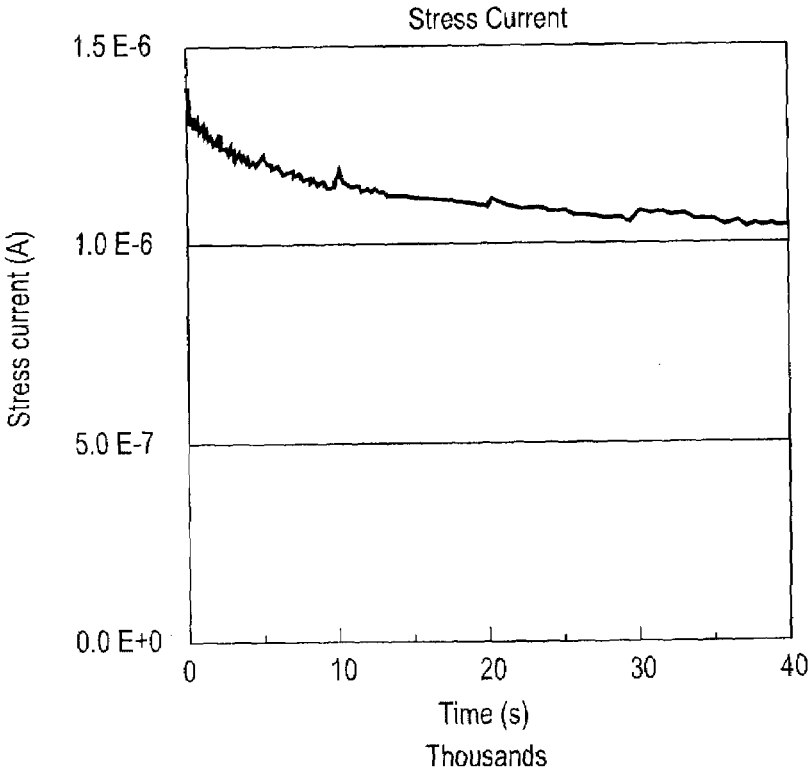
FIG. 8*b* is a graph of stress current versus time, for TFT with channel width-to-length ratio (W/L) of 50/7, driven in linear regime (Vg=25 V, Vd=1 V).

FIG. 8*b* shows stress current versus stress time. Stress current in FIG. 8*b*. is defined as the driver Q2 drain to source current for the BTS condition of FIG. 8*a*.

Figure 9A:
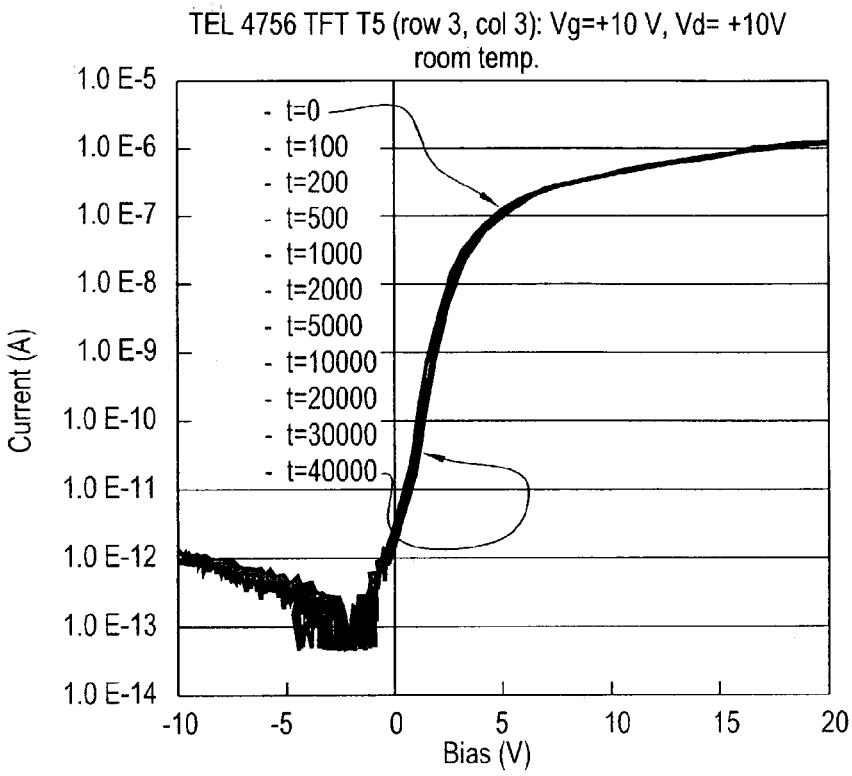
FIG. 9*a* is a graph of drain current versus bias.

FIG. 9*a* is a graph of drain current versus bias for TFT with W/L of 50/7 driven in saturation regime (Vg=Vd=10 V). FIG. 9*a* shows driver Q2 drain to source current versus gate bias as a function of stress time for the bias-temperature-stress (BTS) condition of driver Q2 biased in the saturation region with Vgs=10V, Vds=10V at room temperature. The curves from left to right result from the BTS times of 0, 100, 200, 500, 1000, 2000, 5000, 10,000, 20,000, 30,000 and 40,000 seconds, respectively.

Figure 9B:
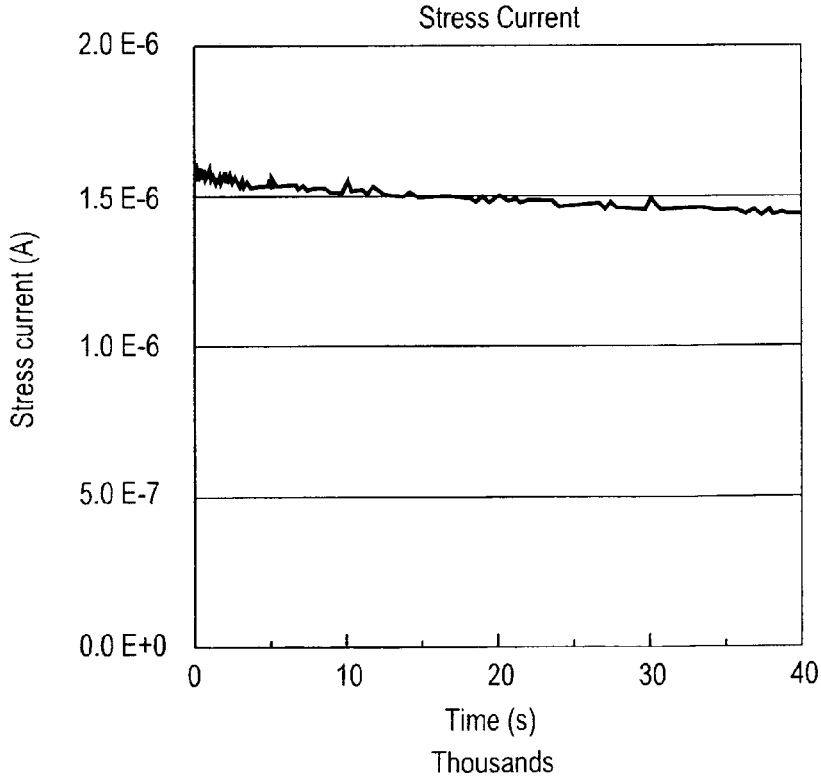
FIG. 9*b* is a graph of stress current versus time, for TFT with W/L of 50/7 driven in saturation regime (Vg=Vd=10 V).

FIG. 9*b* shows stress current versus stress time. Stress current in FIG. 9*b* is defined as the driver Q2 drain to source current for the BTS condition of FIG. 9*a*.

FIG. 9*a* (saturation region biasing) shows approximately 4 times less of a driver Q2 threshold voltage shift compared to FIG. 8*a* (linear region biasing), and FIG. 9*b* (saturation region biasing) shows approximately 2 times less of rate of decrease in stress current compared to FIG. 8*b* (linear region biasing). The saturation and linear region biasing points where chosen to represent approximately equal driver Q2 drain-to-source current at BTS times equal to 0 seconds.

As a result of biasing driver Q2 in the saturation region, OLED 305 voltage and current will change much less than if driver Q2 where biased in the linear region, such as is the biasing for AMLCDs. Additional consideration must be taken into account for amorphous silicon operating voltages for the AMOLED displays of the present invention since the TFT bias is applied for a substantially larger percentage of time, i.e., duty cycles up to 100%, compared to AMLCD duty cycles of less than 1%. To further reverse any induced threshold voltage shift, a voltage of Vgs<Vti can be placed onto driver transistor Q2 as well as onto data transfer transistor Q1. Furthermore, an ability of driver transistor Q2 to faithfully reproduce a gray level current depends on a slope of a saturation region in the output characteristics of driver transistor Q2. In practice, the longer the Q2 channel, the smaller the source-drain resistance to channel resistance ratio, and hence the smaller the output source-drain current change for a given dVt, the change in threshold voltage. The voltages on the Vsupply, Vcathode, scan line and Cs1 are switched to different voltages in time to reduce or compensate for threshold voltage changes. Vcathode is the common supply applied to the common cathode electrode of 310, and scan line is the conductive line connecting the gates of Q1 on a row.

Thus, with reference to FIG. 3, the present invention thus provides a circuit, e.g., pixel circuit EL1, for driving a current mode light modulating device, e.g., OLED 305. Pixel circuit EL1 includes (a) capacitor Cs1 for storing a data voltage, data transfer transistor Q1, controlled by a signal on scan line 320, for coupling the data voltage from signal line 325 to capacitor Cs1, and (c) driver transistor Q2, controlled by the stored data voltage, for driving OLED 305 with current provided from power line 315. Power line 315 is in a plane that is geometrically parallel to a plane within which scan line 320 is located.

Figure 4:
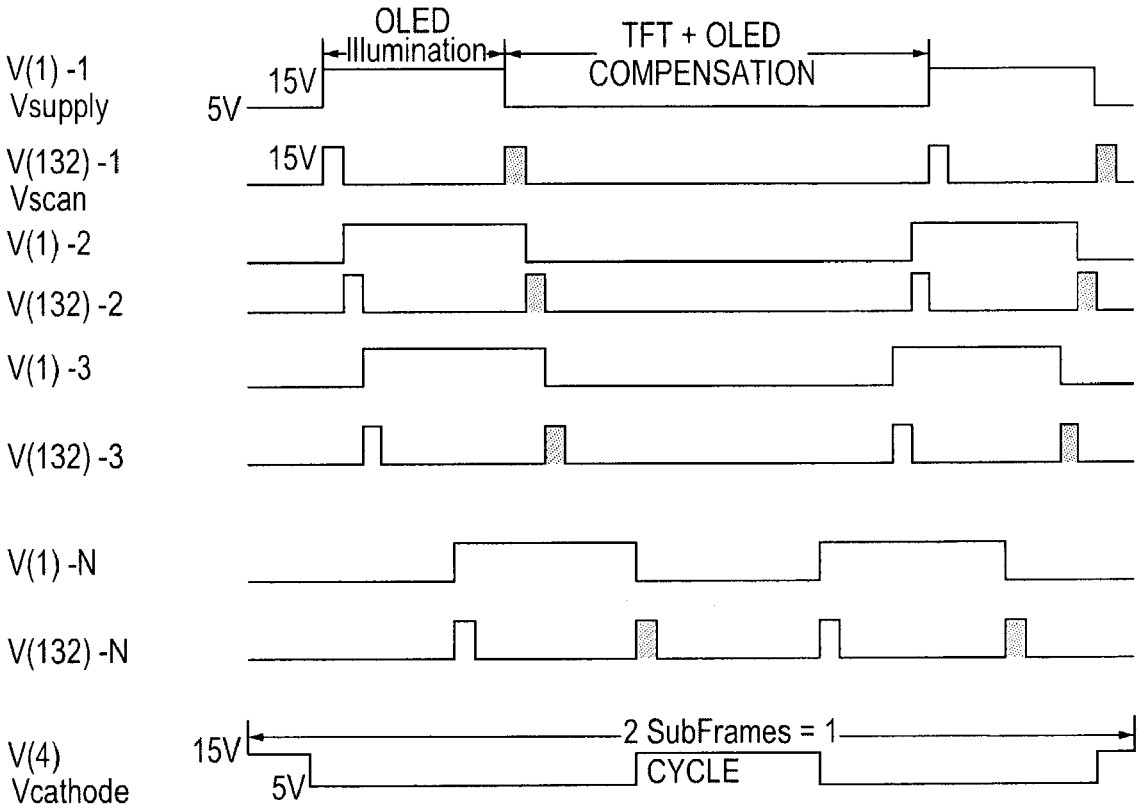
FIG. 4 is a timing diagram of a driving scheme for the circuit in FIG. 3, further extended to N rows of a display.
Figure 4:
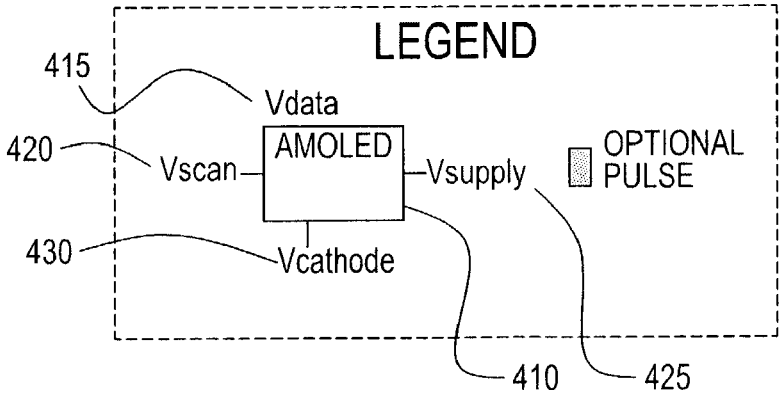

FIG. 4 is a timing diagram of a driving scheme for a circuit such as FIG. 3, further extended to N rows for the functions of pixel writing, OLED illumination, and TFT and OLED compensation. The driving scheme incorporates several features: (1) up to four independent modes of operation; (2) fast data sample and hold through use of bootstrapping, (3) independent row illumination, (4) row-at-a-time addressing and illumination, and (5) Driver Q2 and OLED 305 I–V characteristic shift compensation, which is noted as "OLED Compensation". The legend shows a block diagram representing an OLED array 410, and the voltage waveform inputs to OLED array 410, namely Vdata 415, Vscan 420, Vsupply 425 and Vcathode 430. In this embodiment, V(132)-1, V(132)-2, . . . V(132)-N represent line waveforms analogous to Vscan 420 for row 1, 2, . . . N, respectively, for OLED array 410. V(1)-1, V(1)-2, . . . V(1)-N represent line waveforms analogous to Vsupply 425 for row 1, 2, . . . N, respectively, for OLED array 410. V(4) represents the common array waveform analogous to Vcathode 430 for OLED array 410. In summary:

V(1)-1=Vsupply 425 for the first row;

V(132)-1=Vscan 420 or voltage on the gate of data transfer transistor Q1 for the first scan row;

V(1)-2=Vsupply 425 for the second row; and

V(132)-2=Vscan 420 or voltage on the gate of data transfer transistor Q1 for the second scan row, V(1)-N=Vsupply 425 for the Nth row;

V(132)-N=Vscan 420 or voltage on the gate of data transfer transistor Q1 for the Nth scan row; and V(4)=Vcathode 430 of voltage waveform on the common cathode.

For simplicity, voltage waveform Vdata 415 is not shown, but understood to be of valid data when Vscan 420 is high and turning Q1 on. Shown is a sequential row scan with V(132)-1 through V(132)-N being a double pulse waveform per display subframe. The first pulse defines the pixel data write operation to the gate node of driver Q2, and the second pulse writes the driver Q2 gate compensation level. Coinciding with the sequential row scan of voltage pulse V(132)-1 through V(132)-N is either the rising edge or falling edge of V(1)-1 through (1)-N, respectively. The rising edge establishes the beginning of OLED 310 illumination, where the voltage difference between V(1)-1 through V(1)-N and v(4) establish the bias across driver Q2 and OLED 310 needed for illumination of OLED 310. The falling edge establishes the end of illumination of OLED 310. Note that the row controlled V(1)-1 through V(1)-N makes it possible to do row-at-a-time addressing and illumination, and row independent illumination control. When the falling edge of V(1)-1 through V(1)-N coincides with the rising edge of V(132)-1 through V(132)-N, respectively, the start of driver Q2 or OLED 310 compensation is initiated. Driver Q2 compensation is through reverse biasing the gate to source and the gate to drain. Compensation benefits may result from an increase in the lifetime by threshold voltage shift decrease. Additional lifetime benefit may be derived by biasing the drain voltage lower than the source voltage, as is implemented when V(4) is high and V(1) is low. Typical voltage waveform amplitudes for a-Si TFT active matrix are shown. When V(4) is high and V(1)-1 through V(1)-N is low, the OLED 305 compensation takes place by allowing charge detrapping to take place due to the reverse biased OLED 305.

When a capacitor charges to a voltage, there can be a particle current and a displacement current. The particle current is produced by a flow of positive or negative charges onto a plate of the capacitor. Since a capacitor does not allow an instantaneous change in voltage across the capacitor, when one electrode of the capacitor sees an instantaneous change in voltage, the other electrode of the capacitor also sees the same increase or decrease in voltage. Such an instantaneous change in voltage on the plates of the capacitor, i.e., a voltage pedestal, is brought about by displacement current. Bootstrapping is a technique for introducing a sudden change in voltage on one electrode of a capacitor and inducing a displacement current to force the other electrode to follow the same voltage change.

With reference to FIGS. 3 and 4, note that OLED 305 has a terminal connected to a common electrode, i.e., common cathode 310. Vsupply is a waveform on power line 315, Vcathode is a waveform on common cathode 310, Vscan is a waveform on signal line 325, and signal line 315 has a data voltage waveform thereon. Collectively, the Vsupply, Vcathode, Vscan and data voltage waveforms cooperate to control OLED 305. For example, Vsupply and Vcathode cooperate to reverse bias OLED 305 to reduced trapped charge, and Vsupply, Vscan, and Vcathode cooperate with one another to reduce a threshold voltage shift of driver transistor Q2.

Figure 5A:
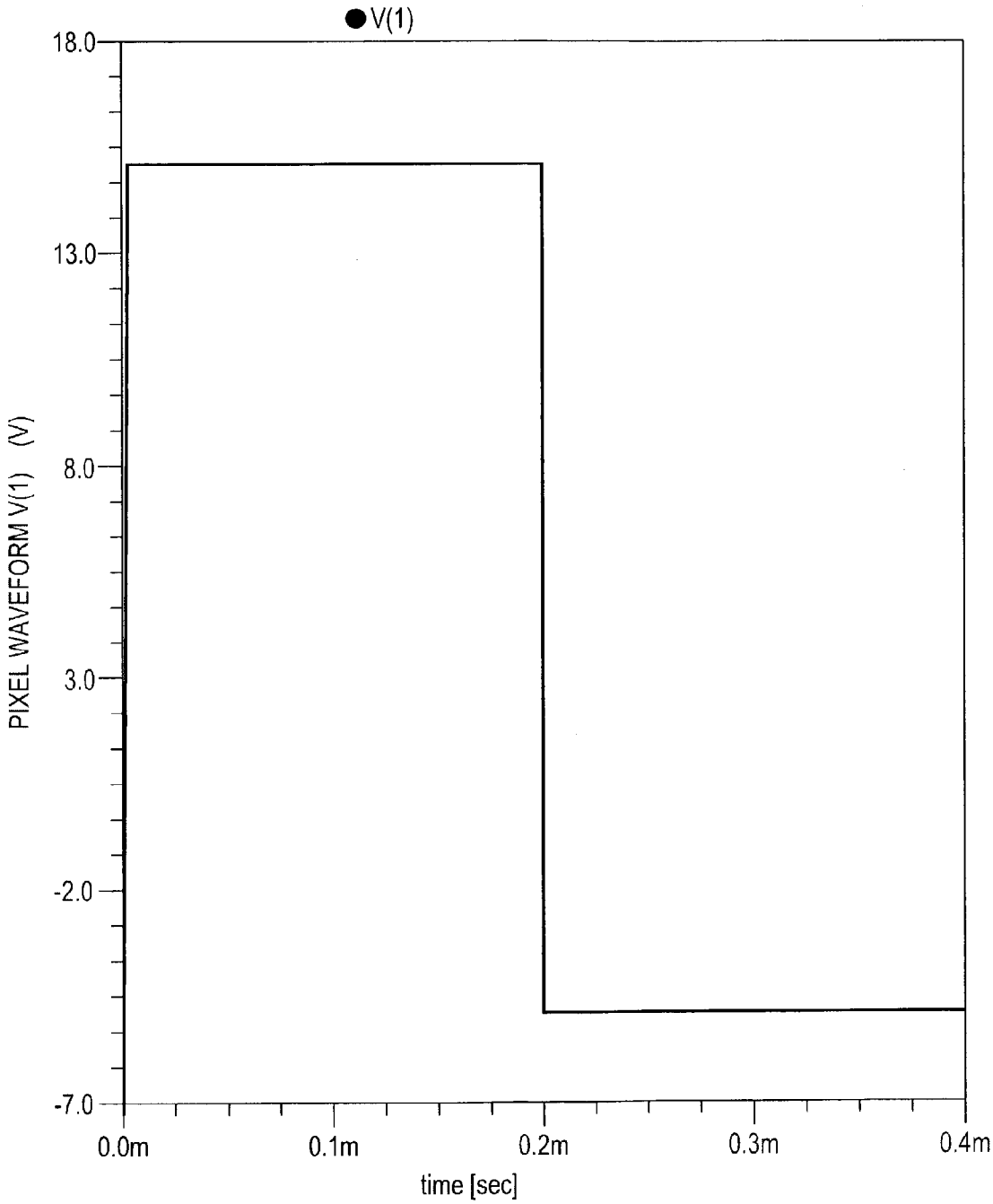
FIG. 5*a* is a graph of a driving scheme simulation showing waveform V(1).
Figure 5B:
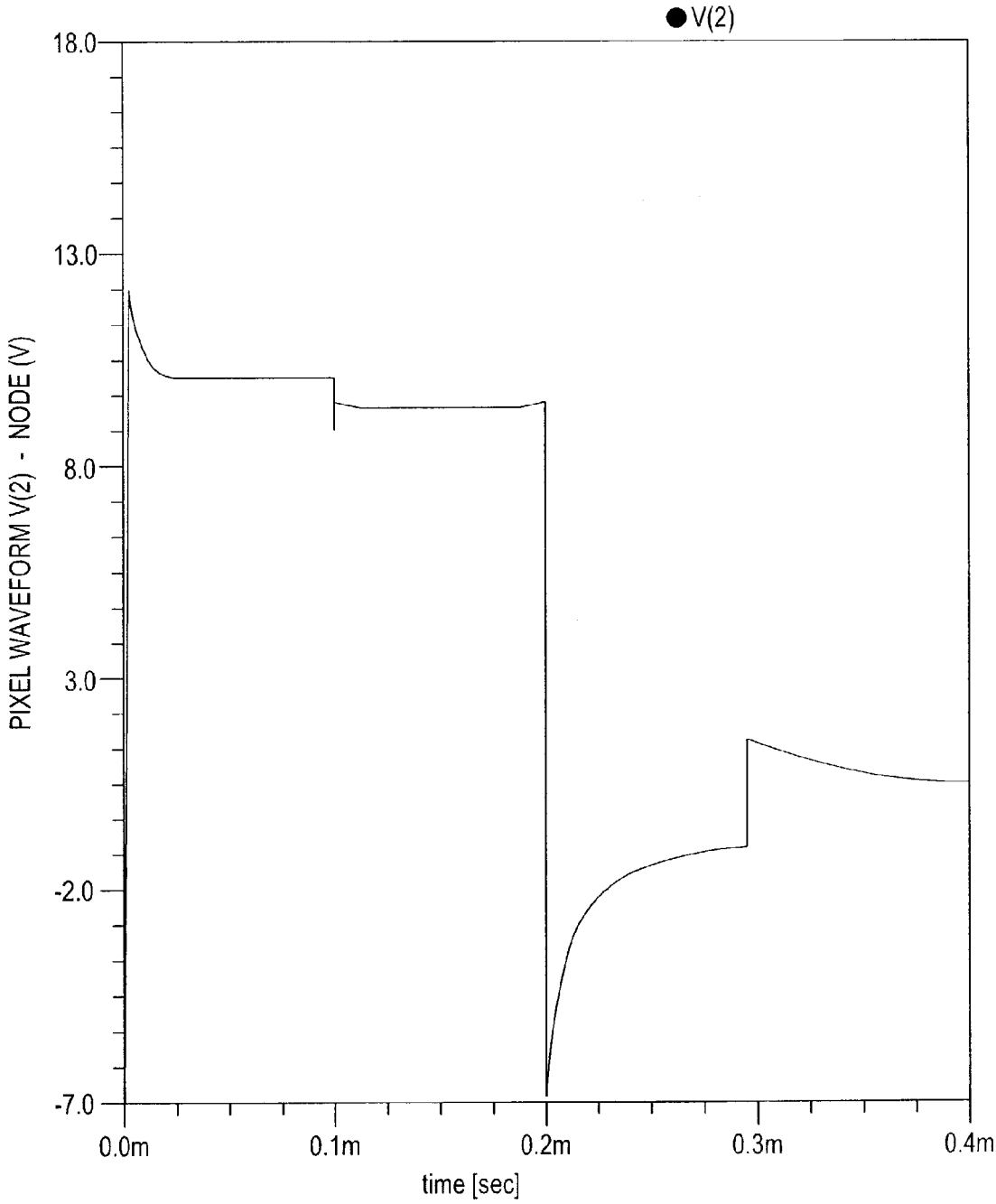
FIG. 5*b* is a graph of a driving scheme simulation showing waveform V(2).
Figure 5C:
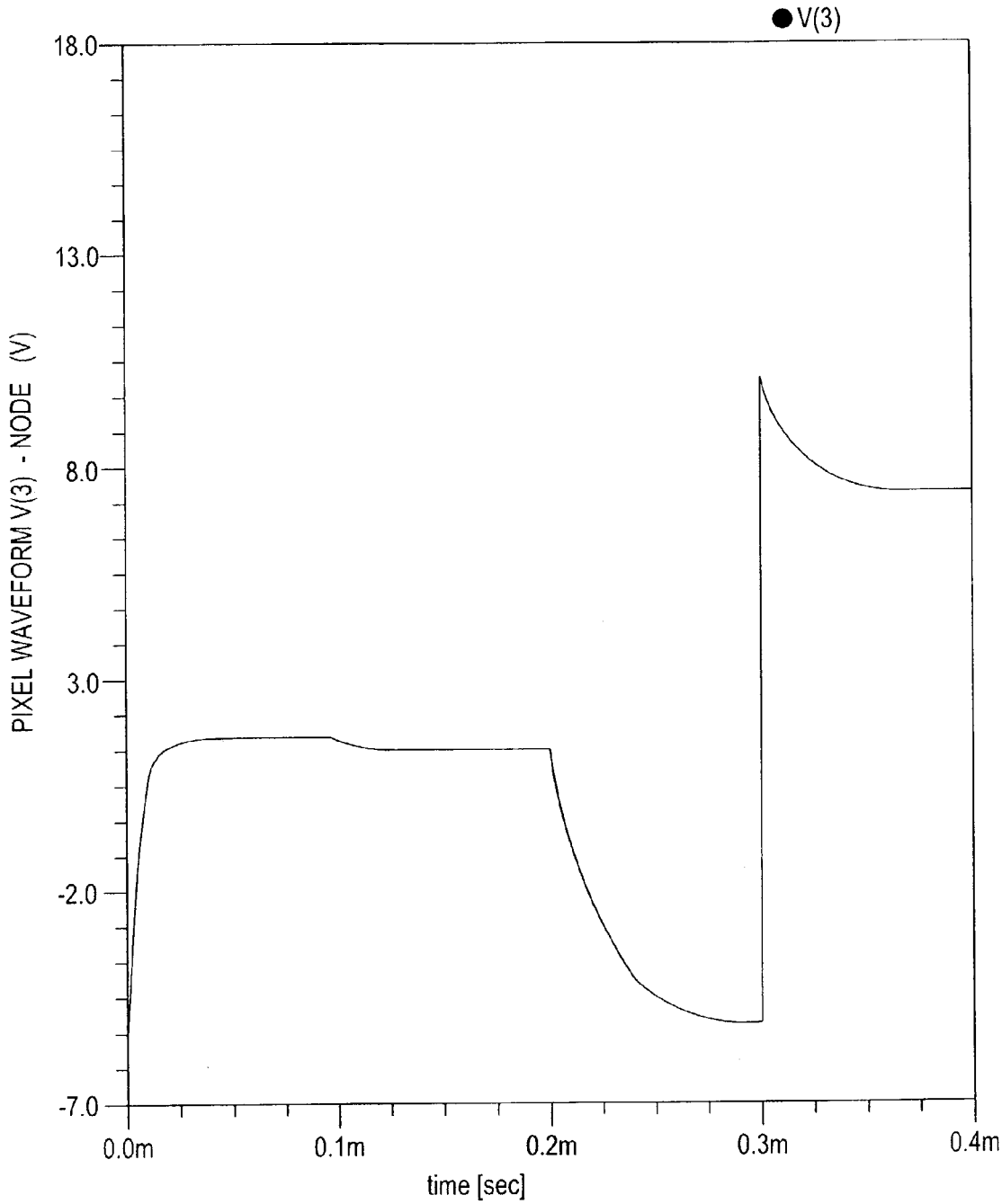
FIG. 5*c* is a graph of a driving scheme simulation showing waveform V(3).
Figure 5D:
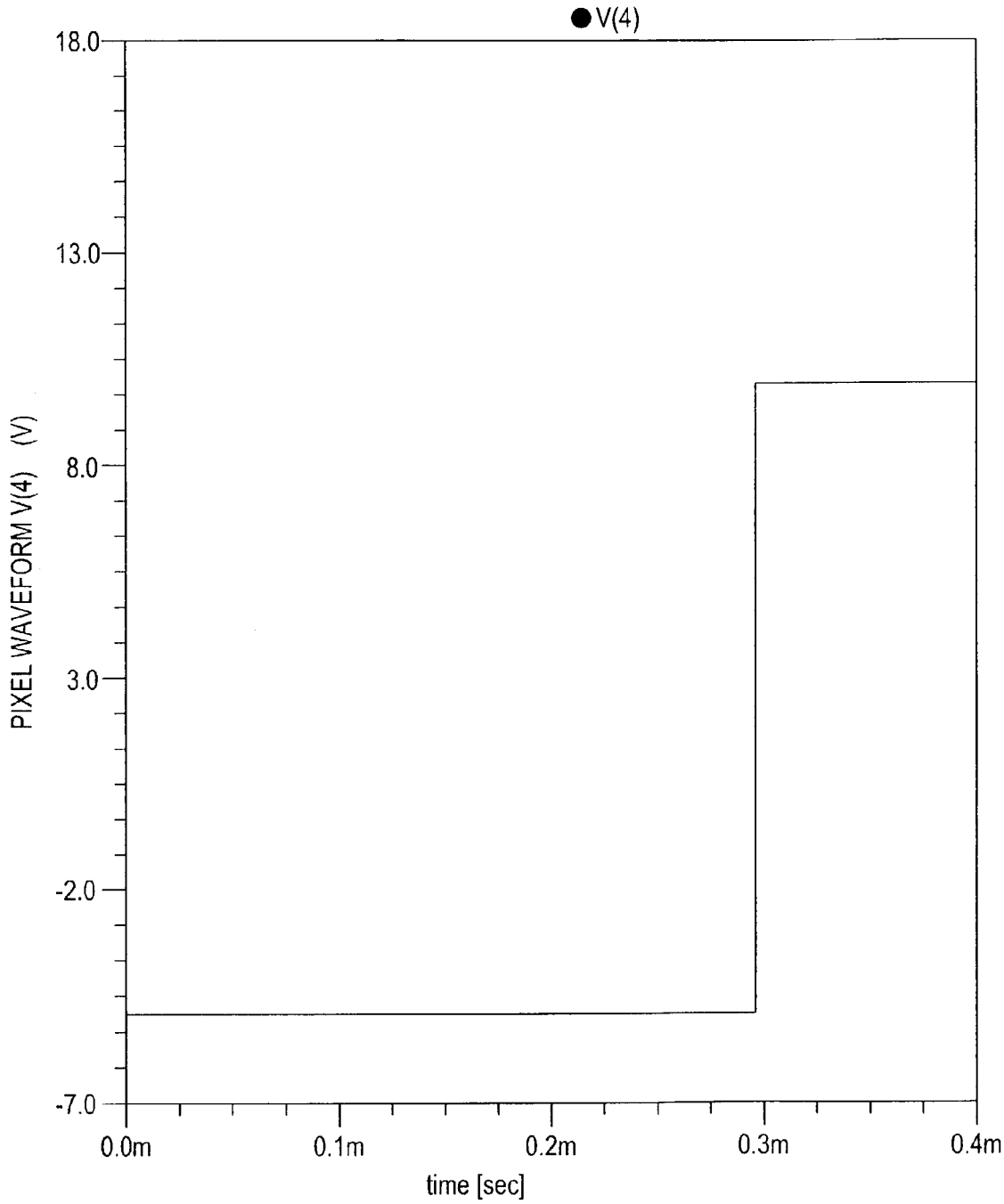
FIG. 5*d* is a graph of a driving scheme simulation showing waveform V(4).
Figure 5E:
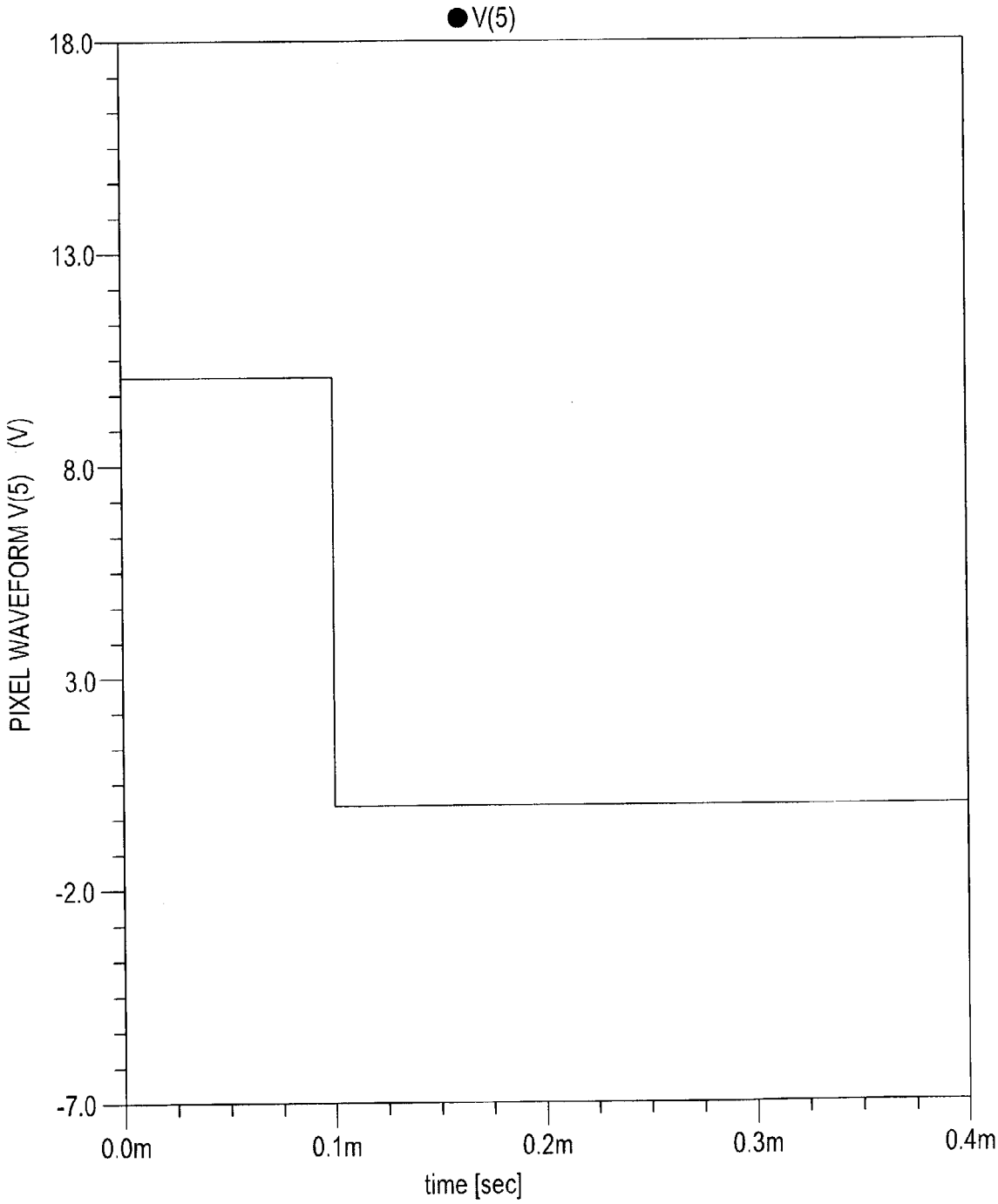
FIG. 5*e* is a graph of a driving scheme simulation showing waveform V(5).
Figure 5F:
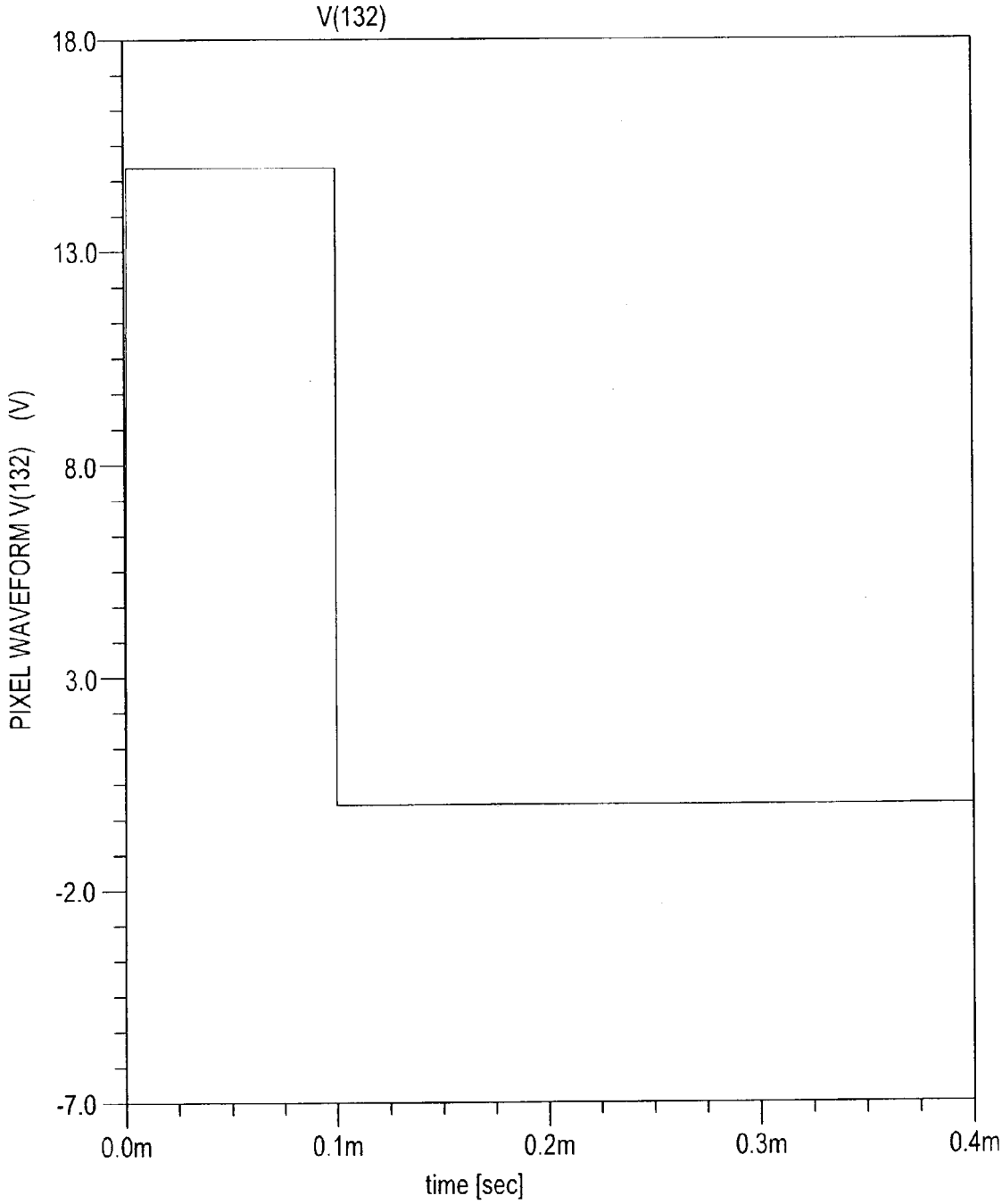
FIG. 5*f* is a graph of a driving scheme simulation showing waveform V(132).
Figure 5G:
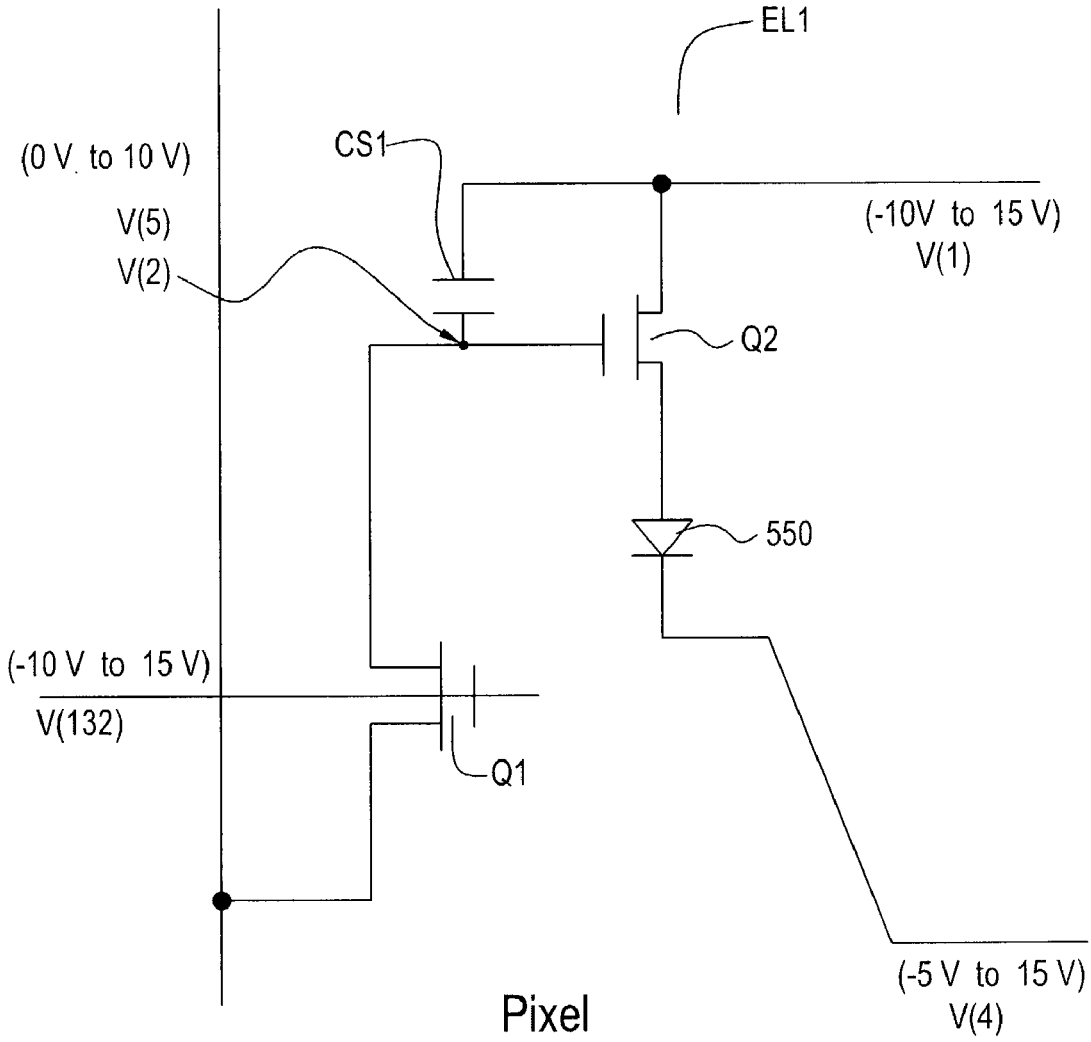
FIG. 5*g* is a schematic of a pixel circuit being driven in accordance with the present invention.

FIG. 5*a* through FIG. 5*f* show a driving scheme simulation, for the circuit of FIG. 5*g* where all node voltages are shown and defined as:

V(1)=Vsupply;

V(2)=data voltage at the gate node of driver transistor Q2;

V(3)=voltage at the anode electrode of OLED 550;

V(4)=Vcathode or the common cathode voltage;

V(5)=Vdata or the data voltage to the drain of data transfer transistor Q1;

and

V(132)=Vscan or the gate node voltage to data transfer transistor Q1.

In general, Vd or Vsupply maximum is larger than Vdata to ensure driver transistor Q2 is driven into saturation. Four independent modes of operation are shown: (1) data voltage writing to pixel during times 0 to 0.1 msec, (2) OLED illumination during times 0.1 msec and 0.2 msec, (3) Driver Q2 compensation resulting in longer driver Q2 lifetime during times 0.2 msec and 0.3 msec, and (4) OLED compensation resulting in longer OLED 550 lifetime during 0.3 msec and 0.4 msec. Typical voltage waveform amplitudes for a-Si TFT active matrix are shown. Note that when V(1) rising edge precedes V(132) rising edge at 0+ seconds, the V(1) rising edge capacitively couples or bootstraps to V(2), thereby pulling up V(2). Shown is a 13V pullup on V(2). Storage capacitor Cs1 employs a displacement current through bootstrapping to facilitate storage of the data voltage. This displacement current provides quick data voltage writing onto V(2) by providing a voltage pedestal, whose voltage divider is the change in V(1) multiplied by Cs1 divided by the total capacitance on gate node driver Q2.

Figure 6:
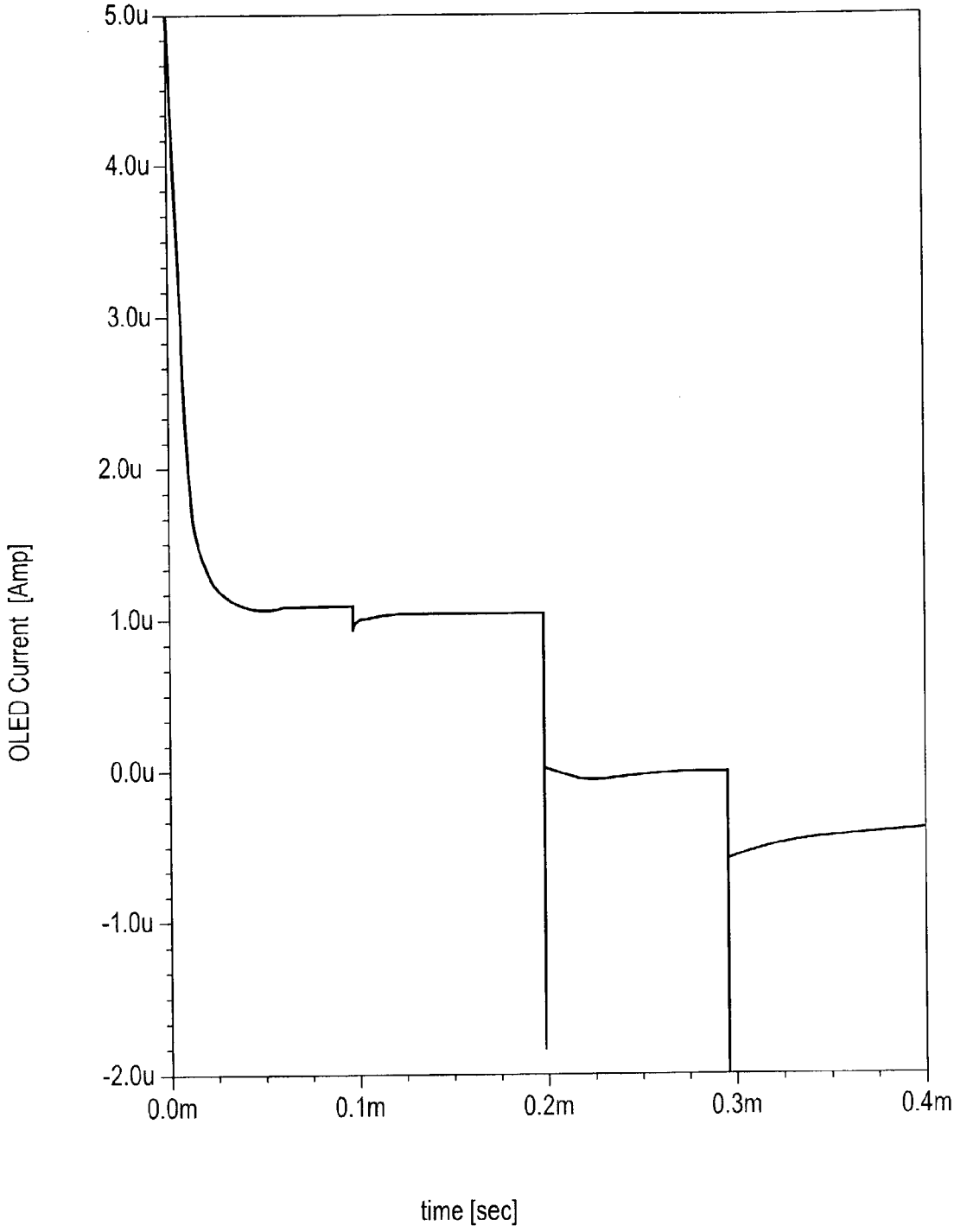
FIG. 6 is a graph of driver TFT source-to-drain current of Q2, which is equal to the OLED current, the pixel circuit of FIG. 5*b*.

FIG. 6 is a graph of driver TFT source-to-drain current of Q2, which is equal to the OLED current, for the pixel circuit of FIG. 5*g*. FIG. 6 shows OLED 550 current versus time for the voltage node biases in FIG. 5*a* through FIG. 5*f*. It also shows current response, i.e., displacement current, at time 0 for a quick charging of a storage capacitance by boot strapping. Note the large displacement current produced from bootstrapping at time 0+ seconds.

Figure 7:
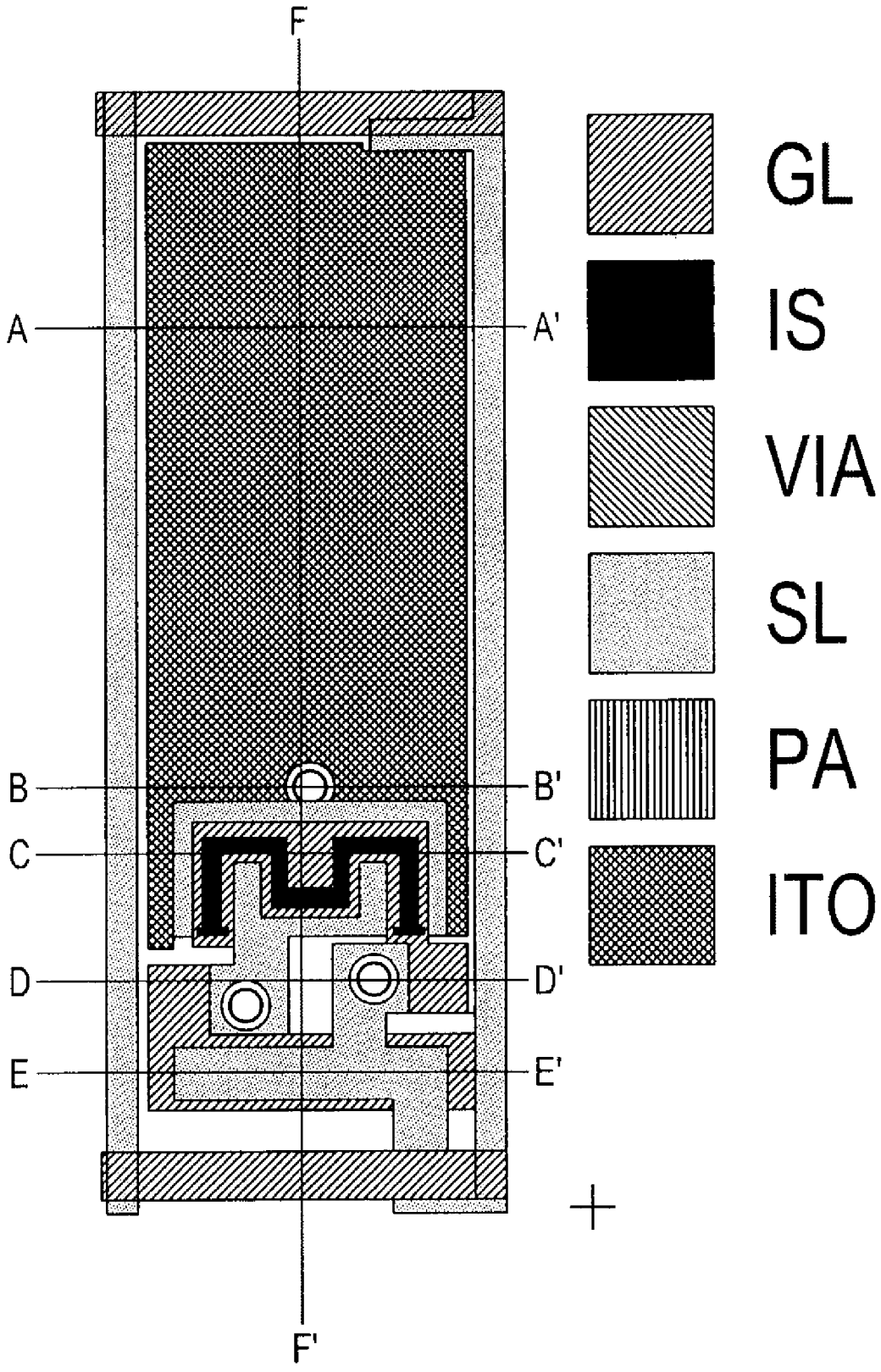
FIG. 7 is a diagram of an a-Si TFT active matrix pixel layout for the circuit of FIG. 5*g*, using a seven photolithographic step a-Si TFT active matrix process.

FIG. 7 shows a layout for the pixel circuit of FIG. 5*g* implemented in a seven-step a-SI TFT active matrix process. There is a gate level metal (GL) or first conductor, an insulator etch stopper (IS) or the patterning of the a-Si and top insulator layer, a via (VIA) or contact hole down to the gate level, a signal level (SL) or second conductor level, a passivation and planarization insulator level patterning (PA), and an indium tin oxide (ITO) transparent conductor. The final passivation layer patterning is not shown.

Figure 10A:
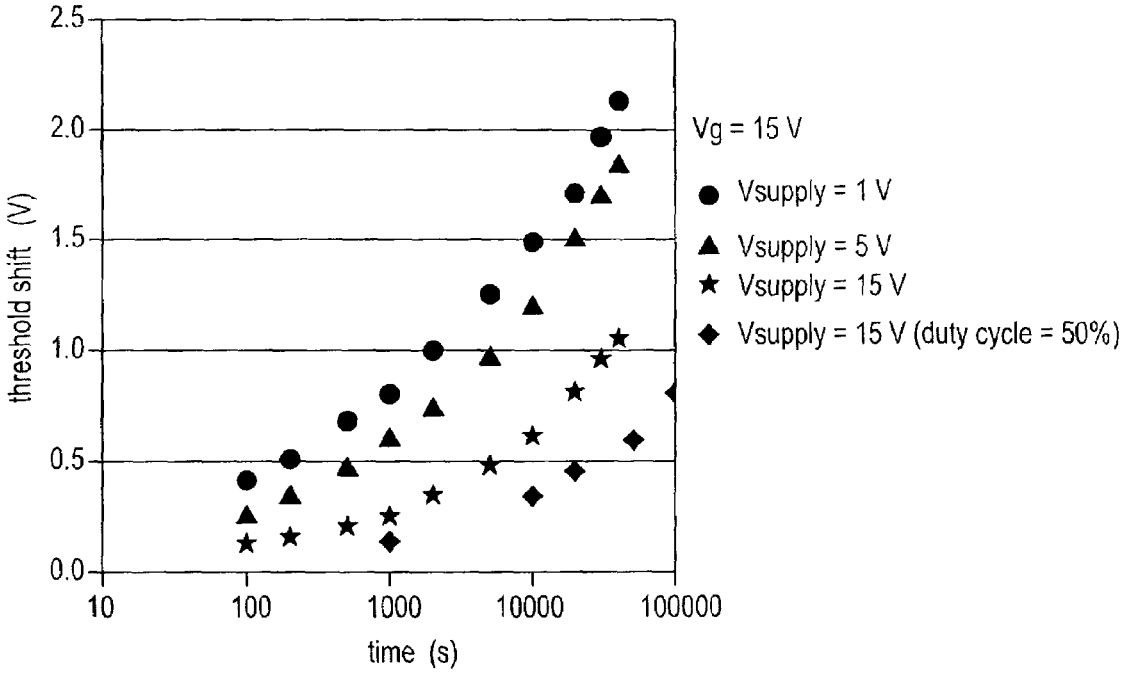
FIG. 10*a* is a semilog plot.
Figure 10B:
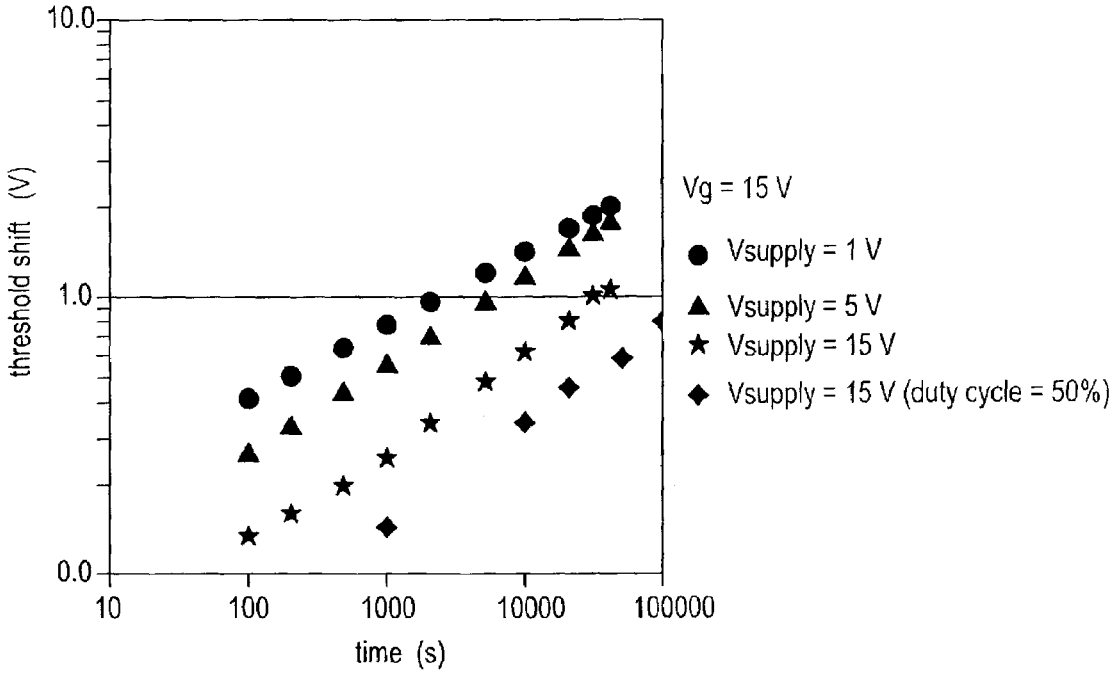
FIG. 10*b* is a log-log plot, of threshold shift versus stress time of TFT stability for Vg=15 V fixed.

FIG. 10*a* is a semilog plot, and FIG. 10*b* is a log-log plot, of threshold shift versus stress time of TFT stability for Vg=15 V fixed. FIGS. 10*a* and 10*b* show the threshold voltage shift of driver Q2 versus BTS time at room temperature.

Figure 11:
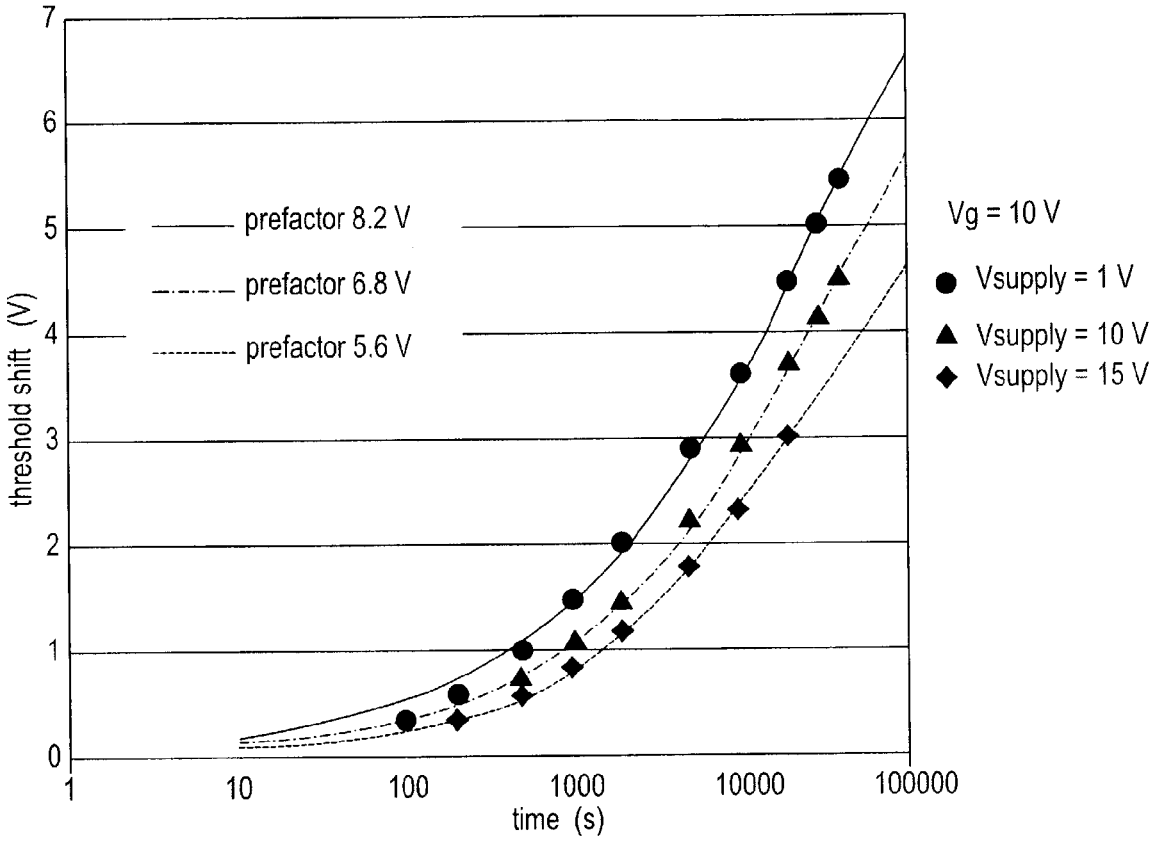
FIG. 11 is a graph of accelerated bias temperature stress at 75C. showing the time dependence of TFT threshold voltage of an a-Si TFT with Vd as a parameter.

FIG. 11 is a graph of accelerated bias temperature stress at 75C. showing the time dependence of TFT threshold voltage of an a-Si TFT with Vd as a parameter. Note that the gate drive prefactor reduction benefit exists in the TFT saturation regime even at higher temperatures.

In FIGS. 10*a*, 10*b* and 11, the parameter stepped is Vsupply of driver Q2, showing that prolonged driver Q2 lifetime is realized for larger Vsupply bias or smaller duty cycles.

This pixel circuit schematic of FIG. 3 and the driving scheme of FIG. 4 can also be applied to polysilicon (p-Si) TFT active matrix technology, however, p-Si TFT technology has other advantages/disadvantages that need to be taken into account for optimization. For example, a p-Si TFT has up to several hundred times more transconductance, typically a mobility in the range of 50 to 300 $cm^2$NV/sec for n-channel and slightly less for p-channel, than an a-Si TFT, with typical mobility in the range of 0.1 to 2 $cm^2$/V/sec, of similar width-to-length channel ratios. Another example is that a p-Si TFT may suffer from TFT I–V characteristic mismatching since nearest neighbor pixel TFT uniformity is more difficult to control due to an inherent recrystallization of a p-SI TFT channel region that produces area proximity random grain sizes and numbers, and non-identical grain boundary properties. The uniformity quality can be measured in a distribution of TFT threshold voltage variations, and hence a distribution of TFT drive currents. In general, P-channel p-Si TFT technology has a smaller threshold voltage distribution compared to n-channel p-Si TFT technology, as well as lower off current leakage that make it a better choice for the pixel TFTs. In general, p-Si TFT technology exhibits higher off current leakage as well as a larger threshold voltage distribution. Also, because of the higher mobility of p-Si compared to a-Si, p-Si TFTs may exhibit channel hot carrier degradation with time, a condition that is exasperated near the drain end of the gate insulator when the ratio of TFT drain voltage-to-gate voltage approaches 2. Hot carrier injection into the gate insulator causes threshold voltage shifts, where differential threshold voltage shifts between pixels are pattern-history dependent and difficult for which to compensate fully. For reasons of hot carrier injection, TFT biasing in the saturation regime (Vds>Vgs−Vth) for p-Si TFTs is less desirable, where:

Vds=drain to source voltage;

Vgs=gate to source voltage; and

Vth=threshold voltage.

In contrast, a-Si threshold voltage instabilities are typically induced by one or two of the following mechanisms; (1) charge injection from the channel interface and charge trapping in the TFT gate insulator, and/or (2) bond breaking in the a-Si semiconductor (Stabler-Wronski effect). The dominant a-Si TFT degradation mechanism is highly dependent on the a-Si and gate insulator film technology. The first degradation mechanism, charge injection and charge trapping in the TFT gate insulator, is field dependent, and hence easily controlled or limited, by the gate insulator electric field and gate insulator technology. A time, temperature and gate bias field dependence exists where TFT threshold voltage shift, dVt, is well described by the stretched-exponential equation $$|dVt|=|dVo|^{\alpha}\times\{1-e^{-(t_{st}/\tau)^{\beta}}\}$$

where dVo=(Vgs−Vti), is approximately the initial voltage drop across the insulator, $\tau=\tau_0 e^{(E_t/kT)}$ is the characteristic trapping time, where the thermal activation energy $E_a=E_t\times\beta$, with β being the stretched-exponential exponent.

This distribution of multiple traps in the gate insulator yields a power law time dependence βo~1.04 and To~229K for the expression β=(Tst/To)−βo for positive gate voltages. Typical values are β~0.248 and 0.22, $E_t$~1.17 and 0.97 eV for positive and negative gate bias stress, respectively.

For the gradual channel conditions, i.e., TFT linear region, where Vds<(Vgs−Vth), α~1. For the TFT operating in the saturation region, α can be dramatically reduced below 1.

The design aspects of the pixel layout and the driving method of the present invention incorporate several advantages. Three of these advantages are described below.

A first advantage exists for pixels biased in the saturation region, where the larger the Vds-to-Vgs ratio, the lower the threshold voltage shift, dVt. Also, note that a positive and negative Vgs bias produces a positive and negative dVt shift, respectively, with the zero Vth shift crossover being at Vgs~Vti, where Vti is the initial threshold voltage.

A second advantage exists if negative Vgs bias can be applied to offset the positive Vgs bias induced dVt. In addition, β may be gate pulse frequency dependent because of a thermal release of trapped charge between gate pulses, and a typical difference in the β values are 0.233 for gate pulse conditions between ~0.125% and ~33.3% duty cycle, to 0.248 for steady state, i.e., duty cycle=100%, gate conditions. Since β is gate pulse frequency dependent, $$dVt(t_{st}(\text{pulse}))\left[\frac{100\%}{DC}\right]<dVt$$

where $t_{st}$(pulse) is the TFT accumulated pulse width stress time, and DC is 100% duty cycle. In addition, some insulators may favor injection of the opposite charged carriers, holes or electrons, which produces less net effectively charged gate insulators, and less dVt.

A third advantage exists in minimizing dVt. This is achieved if pulse bias, i.e., duty cycle<100%, is used rather than 100% duty cycle.

The present invention provides for a line-sequential scanning and constant-voltage driving sequence to drive a pixel composed of two TFTs, i.e., an access and driver TFT, one storage capacitor, and four externally accessible control lines/signals (SCAN, SUPPLY, DATA, and COMMON OLED electrode). The driving sequence is segmented functionally into four segments; (1) data sample and hold, (2) pixel illumination, (3) driver TFT compensation, and (4) OLED compensation.

It should be understood that various alternatives and modifications of the present invention. Nonetheless, the present invention is intended to embrace all such alternatives, modifications and variances that fall within the scope of the appended claims.

What is claimed is:

1. A circuit for driving a current mode light modulating device, comprising:

a capacitor for storing a data voltage;

a field effect transistor (FET) controlled by a signal on a scan line, for coupling said data voltage from a signal line to said capacitor; and a current source, controlled by said stored data voltage, for driving said device with current provided from a power line, wherein said power line is in a plane that is geometrically parallel to a plane within which said scan line is located, wherein said device has a terminal connected to a common electrode, and wherein said power line has a first waveform thereon, having a plurality of voltage levels, that influences an operation of said circuit and operates in cooperation with a second waveform on said common electrode to reverse bias said device to reduce trapped charge in said current source.

2. The circuit of claim 1, wherein said signal line has third waveform thereon, and said scan line has a fourth waveform thereon, and wherein said first, seconds, third and fourth waveforms cooperate with one another to control said device.

3. The circuit of claim 1, wherein said FET and said current source are connected to a common node, and wherein said capacitor is connected between said common node and said power line.

4. The circuit of claim 3, wherein said capacitor employs a displacement current through bootstrapping to facilitate said storage of said data voltage.

5. The circuit of claim 1, wherein said first waveform is an alternating current (AC) waveform.

6. The circuit of claim 1, wherein said second waveform is an alternating current (AC) waveform.

7. The circuit of claim 1, wherein said device is an organic light emitting diode (OLED).

8. The circuit of claim 1, wherein said circuit is a member of a plurality of such circuits configured in a row, and wherein said power line and said scan line are connected to said plurality of circuits.

9. The circuit of claim 8, wherein said row is a first row in an array, wherein said power line is a first power line and said scan line is a first scan line, wherein said array includes a second row of said circuits, and wherein said second row is connected to a second power line and a second scan line.

10. The circuit of claim 1, wherein said FET and said current source comprise amorphous silicon.

11. The circuit of claim 10, wherein said current source is biased in its saturation region.

12. The circuit of claim 10, wherein said current source is biased to allow current flow less than 100% of the time.

13. A circuit for driving a current mode light modulating device, comprising:

a capacitor for storing a data voltage;

a field effect transistor (FET) controlled by a signal on a scan line, for coupling said data voltage from a signal line to said capacitor; and a current source, controlled by said stored data voltage, for driving said device with current provided from a power line, wherein said power line is in a plane that is geometrically parallel to a plane within which said scan line is located, wherein said power line has a first waveform thereon that influences an operation of said circuit, wherein said device has a terminal connected to a common electrode, wherein said signal line has a second waveform thereon and said common electrode has a third waveform thereon, and wherein said first, second and third waveforms cooperate with one another to reduce a threshold voltage shift of said current source.

14. An active matrix organic light emitting diode (AMOLED) display comprising:

a plurality of pixel circuits in a row, wherein each of said pixel circuits includes:

(a) a capacitor for storing a data voltage;

(b) a first field effect transistor (FET) controlled by a signal on a scan line, for coupling said data voltage from a signal line to said capacitor; and (c) a second FET, controlled by said stored data voltage, for driving an AMOLED in said display with current provided from a power line, wherein said AMOLED has a terminal connected to a common electrode, wherein said power line is in a plane that is geometrically parallel to a plane within which said scan line is located, wherein said power line and said scan line are connected to each of said pixel circuits in said row, and wherein said power line has a first waveform thereon, having a plurality of voltage levels, that influences an operation of said plurality of pixel circuits and operates in cooperation with a second waveform on said common electrode to reverse bias said AMOLED to reduce trapped charge in said second FET.

15. The circuit of claim 14, wherein said first FET and said second FET comprise amorphous silicon.

* * * * *